US006474650B1

(12) United States Patent
Looney

(10) Patent No.: US 6,474,650 B1
(45) Date of Patent: Nov. 5, 2002

(54) METHOD OF SIMULATION TIME TRAVEL IN A CARD GAME

(76) Inventor: Andrew J. Looney, P.O. Box 761, College Park, MD (US) 20740

( * ) Notice: Subject to any disclaimer, the term of this patent is extended or adjusted under 35 U.S.C. 154(b) by 0 days.

(21) Appl. No.: 09/902,955

(22) Filed: Jul. 11, 2001

(51) Int. Cl.[7] ..... A63F 1/00
(52) U.S. Cl. ..... 273/308; 273/296; 273/300
(58) Field of Search ..... 273/308, 292, 273/296, 300, 302

(56) References Cited

U.S. PATENT DOCUMENTS

| | | | | | |
|---|---|---|---|---|---|
| 972,371 | A | * | 10/1910 | Hammett | 273/302 |
| 5,090,707 | A | * | 2/1992 | Patz | 273/298 |
| 5,662,332 | A | * | 9/1997 | Garfield | 273/308 |
| 5,772,213 | A | * | 6/1998 | McGlew | 273/308 |
| 6,179,294 | B1 | * | 1/2001 | Turnali | 273/292 |
| 6,318,723 | B1 | * | 11/2001 | Kurita | 273/157 R |

* cited by examiner

*Primary Examiner*—Benjamin H. Layno
*Assistant Examiner*—Vishu K Mendiratta

(57) ABSTRACT

Although traveling through time is impossible, the idea can still be examined in works of fiction, including card games. A Timeline of events is presented, arranged in chronological order, on two-sided playing cards. During the course of a game, players representing "time travelers" may alter the outcome of past events. This is simulated by turning over specific cards on the Timeline, called Linchpins, which represent pivotal moments in history. Symbols on these and other cards indicate how history becomes different as a result of these changes. Other cards, called Ripplepoints, are follow-on events that change when dependent prior events are altered, and are also turned over when Linchpin cards are changed. The method of associating past and future events with icons on the cards allows for easy upkeep of the ever-changing Timeline without needing to grasp the complex logic behind the imagined reasons for the cascading alternate realities. This system can therefore serve as a basis for simulating various time travel scenarios in card games and related media.

1 Claim, 3 Drawing Sheets

METHOD OF SIMULATION TIME TRAVEL IN A CARD GAME

FIELD OF THE INVENTION

This invention relates to card games, specifically to the subject of time travel as it is depicted and simulated in the context of parlor games played with specially-designed playing cards.

DISCUSSION OF THE PRIOR ART

Time travel, while not actually possible, is a rich and exciting concept that has frequently been depicted in popular narrative forms. Everyone dreams of somehow traveling back in time to undo past mistakes. However, while the idea is commonly used in such media as stories, movies, and videogames, time travel has rarely been explored by traditional parlor games (setting aside role-playing games). Because of the complexity and difficulty of simulating the paradoxes and alternate realities that would result from the changing of history, if such a thing were actually possible, only a handful of time-travel-themed board games have ever been released, and prior to the invention of this method, no time travel card game has been published.

In 1992, TimJim/Prism Games released "Time Agent", a board game which allows players to manipulate the past using a board made up of hex-shaped tiles. However, the system of connecting pathways on these tiles was complex and unintuitive, employing square chits as well as tiles, tokens, and a gameboard. Moreover, the events one could change were vague and abstract, taking place on a galactic scale, with unclear relationships and causalities. One doesn't really get the sense of using time travel to change the past from playing this game. Just as ineffective is "Time War", published in 1979, which employed chits on a board made up of concentric rings, with the innermost ring being the furthest back in time; here again, the player's ability to alter history was almost entirely abstract. The game had more to do with competing efforts to fund and build time travel devices than with the relationships between past and future events. Finally, there is "Time Pirates", published in 2000, a board game in which time travel is just window dressing. The gameplay is simply a treasure hunt across history, with no provision at all for players to change events of the past. All of these games are large, equipment intensive board games.

The invention described below is embodied in a new card game entitled "Chrononauts", which was published by Looney Labs in October 2000. The action of "Chrononauts" takes place over a span of more than a century and focuses on a series of major historical events spread out over a 32 card grid. However, for the purposes of explaining the underlying method it employs, a simple 5 card Timeline from an imaginary game will be presented here.

SUMMARY OF THE INVENTION

This invention provides the basis for a game about time travel, by first establishing a "history" on a sequence of playing cards, collectively referred to as the Timeline, then noting "changes" to this history with changes to the placement of these cards and/or the placement of additional cards. Icons on the cards show the causality between specific events in the past and others in the future, so that when history is altered in the past, the impact of such changes on future events can be seen and properly responded to, by turning over additional cards or placing new cards atop them.

DESCRIPTION OF THE INVENTION

Figure 1:
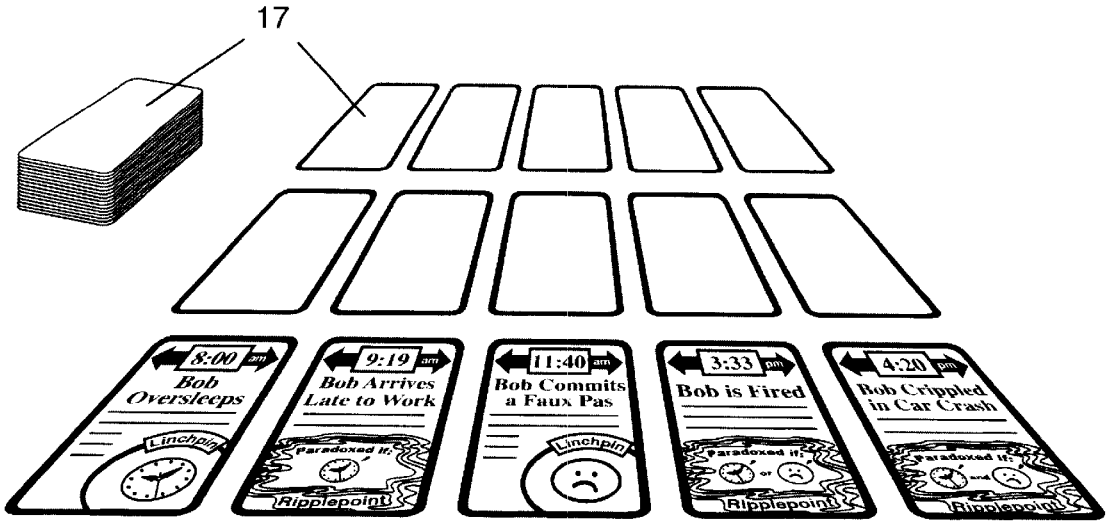
FIG. 1 is a perspective view of a typical embodiment of the invention. In the center of the table is an arrangement of two-sided cards, each listing a time and an event, which collectively are referred to as the Timeline. Other cards are dispensed to players from the draw pile shown on the left.

Playing Card 17 is used by this invention in both single-sided and double-sided forms. A set of two-sided playing cards is arranged to form a Timeline. This is a collection of historical events that can be changed during the game through the imagined use of time travel, The cards in the Timeline will be two-sided, with the fronts and backs depicting different versions of the same moment in time. Thus, when these cards are arranged on the table, they can be individually flipped over by the players to reveal alternate historical events. These may be of two types: different outcomes for pivotal moments in history, these being referred to as "Linchpins", and reshaped realities further along in the timestream, called "Ripplepoints", which occur (or fail to occur) as a result of the altered Linchpin events. Additional cards from a randomized pile of cards (the "Draw pile") provide players with in-game options, including the ability to change history by flipping a Linchpin card on the Timeline. Other cards from the Draw pile, called "Patches", may be placed on top of Timeline cards to further denote changes to the historical reality. A method of associating past and future events via icons on the cards allows players to easily make the needed adjustments to the simulated history, without having to understand the logic behind the imagined alternate realities. This mechanism for simulating the ever-changing alternate realities of a history being tampered with by time travelers can be used as the basis for any number of parlor games with a time travel theme.

Operation of the Invention

The imaginary sample game depicted here focuses on the passage of a single day, and on events that occur to various people at different times during this day. The example segment of this game's Timeline depicted in the drawings and described below focuses on the events that happen to "Bob" on this day.

Figure 2:
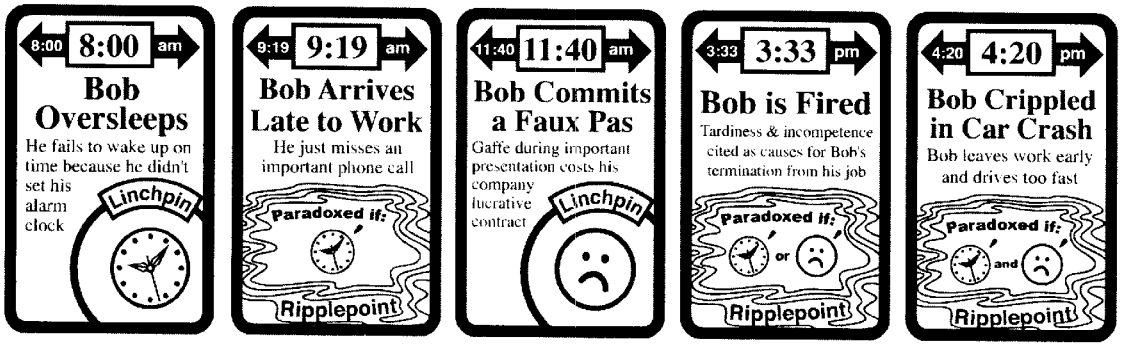
FIGS. 2–8 are top down views of a five card sequence from an imaginary sample game based on this invention. These diagrams depict this example Timeline as it might appear at various stages of the game. Most of the cards shown in these diagrams are two-sided Timeline cards flipped to one side or the other; in some cases, additional cards from the draw pile have been placed on top of Timeline cards.

FIG. 2 depicts the sample Timeline in its base state, as it might appear at the start of a game, before any time travelers have changed the past. Each card in the Timeline is a single event, preferably arranged so that it shows progression from earliest event to latest. As you can see by reading the events described, these cards tell a story with an ending ("Bob Crippled in Car Crash") a time traveler might seek to change. Two cards in this Timeline ("Bob Oversleeps" and "Bob Commits a Faux Pas") are classified as "Linchpins", these being pivotal moments in time which could easily be tampered with by time travelers (if such a thing were actually possible). The other 3 cards are referred to as "Ripplepoints", these being follow-on events in history which can be "rippled", i.e. changed indirectly, through changes made to the Linchpins in the Timeline.

Figure 3:
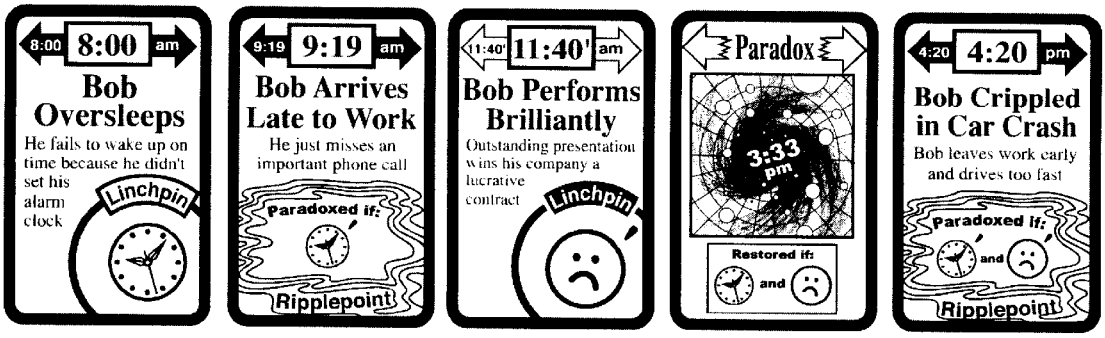

FIG. 3 depicts a Timeline that has been altered. Other elements of the game (the particulars of which need not be specified here) will provide players with opportunities to "change history" (as well as to "repair paradoxes" using additional cards dispensed to them from the Draw pile). In FIG. 3 we see that a player has exercised such an option to "change history", by flipping over one of the Linchpins, in this case the centermost, the event that occurs at 11:40 AM: "Bob Commits a Faux Pas". Now we can see that the other side of this card reveals a different event, "Bob Performs Brilliantly."

This brings us to the repercussions on the future caused by changing events in the past. Clearly, Bob will not be fired at 3:33 PM if his gaffe at 11:40 that morning can be erased . . . but will this change the accident that befalls Bob at the end of the day? We look to the symbols on the cards to find out.

Note that each Linchpin card bears a large symbol, with smaller versions of one or both of these icons also appearing on each of the Ripplepoint cards. These icons denote the linkages between events in the Timeline, showing which Ripplepoint card(s) are affected when a Linchpin card is flipped. The specific appearance of these icons will vary with the scenario depicted in the game and should be designed to correspond to the subject matter of the cards they appear on. For example, since the 8:00 AM Linchpin relates to clocks, the icon for this event is a stylized clock face. Similarly, since the 11:40 AM Linchpin has to do with an embarrassing mistake, the symbol here is a frowny face.

Notice too that just as the Linchpin cards have a base state and an altered state, so too do the icons and timestamps they bear. Observe that the time shown at the top on the flip side of the centermost card in FIG. 3 is 11:40' rather than simply 11:40. The accent mark, or prime symbol (') is used to denote that this is the altered state of the Linchpin. The prime symbol is also added to the icon for the Linchpin. Other means of differentiating the two forms of a Linchpin's icon and time/date are possible, for example, through the use of opposing colors.

Looking again at FIG. 3, and comparing it with FIG. 2, we see that after turning over the 11:40 Linchpin, the 3:33 Ripplepoint has also been turned over, revealing what is called a "Paradox". In the preferred embodiment, the flipside of a Ripplepoint represents a "hole" in the "Space-Time Continuum", i.e. a damaged area of the Timeline, which must be repaired through the placement of "Patch" cards that cover these holes. These Patch cards reveal the alternate flow of history and the different events that would have occurred as a consequence of changing a Linchpin event.

The symbols on the front of a Ripplepoint indicate the conditions under which the card should be turned over. Notice that the front of the 3:33 card, shown in FIG. 2, says "Paradoxed if:" followed by the primed versions of both of the Linchpin icons, separated by the word "or". This means that this card is turned to the Paradox side, if either of the Linchpin events indicated has been turned to the primed state. Since in FIG. 3 the 11:40' event is showing, the Ripplepoint at 3:33 must also be flipped over, as shown.

Note however that the Ripplepoint at 4:20 remains in its original state. This is because both of the connected Linchpins must be flipped in order to ripple the 4:20 event, as shown by the fact that the Linchpin icons on the card are joined with an "and" rather than an "or". The card at 4:20 should remain face up until both the 8:00 and 11:40 Linchpins have been flipped.

Figure 4:
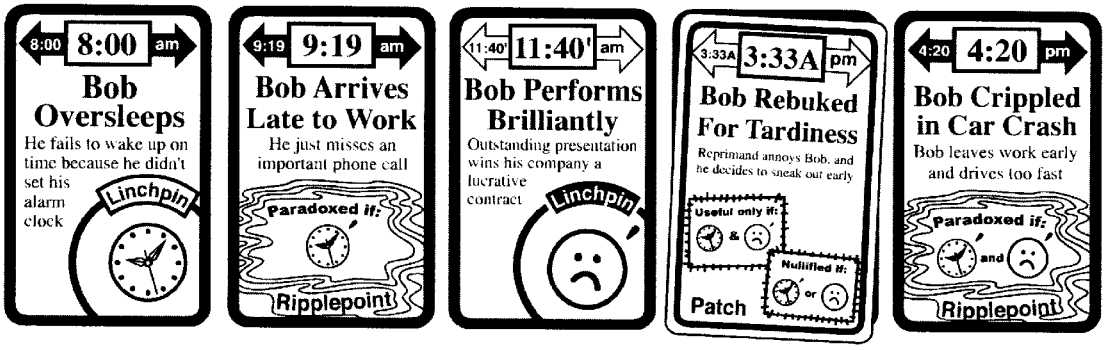

FIG. 4 depicts the use of a Patch card, 3:33-A. Since several different alternate realities are possible for 3:33, depending on what happened earlier in the day, these Patches will be marked with letter suffixes rather than prime marks. The first of these shows that if Bob avoids the gaffe during the presentation at 11:40, he won't be fired; however, he'll still be reprimanded for getting to work late. In disgust at being rebuked for mere punctuality after performing so well in the meeting, Bob leaves work early, just as he would have had he been fired, and still winds up being terribly injured in the car wreck. In order to change his fate at the end of the day, it will be necessary for a time traveler to go back to the beginning.

Notice that the 3:33-A Patch has a note regarding the conditions under which the Patch is "Nullified." This means this card is removed from the Timeline if the conditions shown are met, just as a Ripplepoint with a similar set of instructions would be turned over. But the 3:33-A Patch includes a second set of linchpin symbols, under the words "Useful Only If". These symbols indicate that the card can only be used to patch the 3:33 Paradox if the exact conditions called for are met.

So let's assume that at this point in the game, another player (with opposing goals) decides to set Bob back by restoring the original reality of 11:40 AM. The result of this would look exactly like FIG. 2 (hence a redundant drawing was not included). The process would begin when a player flips the card in the center back to the 11:40 side, after which the 3:33-A Patch would be "Nullified" (i.e removed from the Timeline). After this, the 3:33 Paradox beneath it would also be turned back to the original side (i.e. "Restored"), since at this point we'd be completely back to the original reality.

Figure 5:
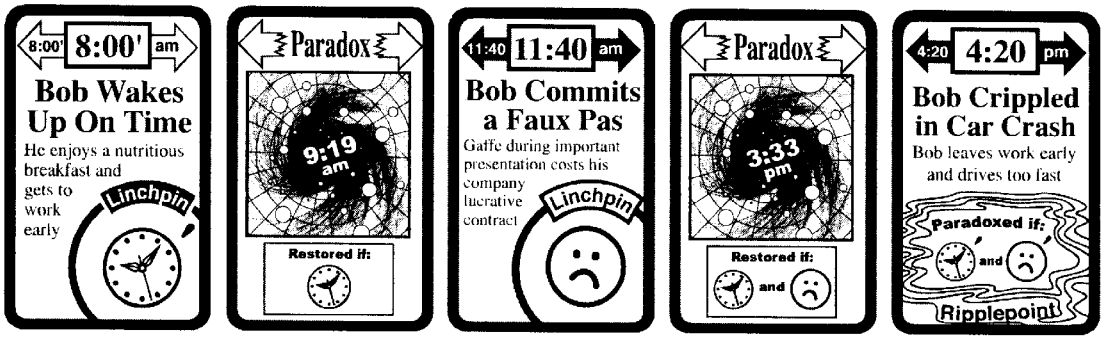

FIG. 5 shows the sample Timeline segment at a still later point in the game. Now Bob has undone his first mistake of the day, by correctly setting his alarm clock so that he wakes up on time. This ripples the second card in the sequence, "Bob Arrives Late to Work," since this event has become paradoxical, given that Bob didn't oversleep. Note that this Ripplepoint depends only on the 8:00 Linchpin; this means this card will always be flipped when the connected Linchpin is flipped, and that only one Patch card will fit the Paradox side, unlike the more complex situation at 3:33.

The 3:33 card has also been rippled in FIG. 5, not because of his improved handling of the presentation at 11:40 (his change to which was undone by another time traveler) but because of his timely arrival at work. Notice again that the events of 3:33 can be rippled by changing either of the Linchpin events it depends on. However, the 4:20 event remains unchanged at this time, since to ripple this event, both Linchpins must be reversed.

Figure 6:
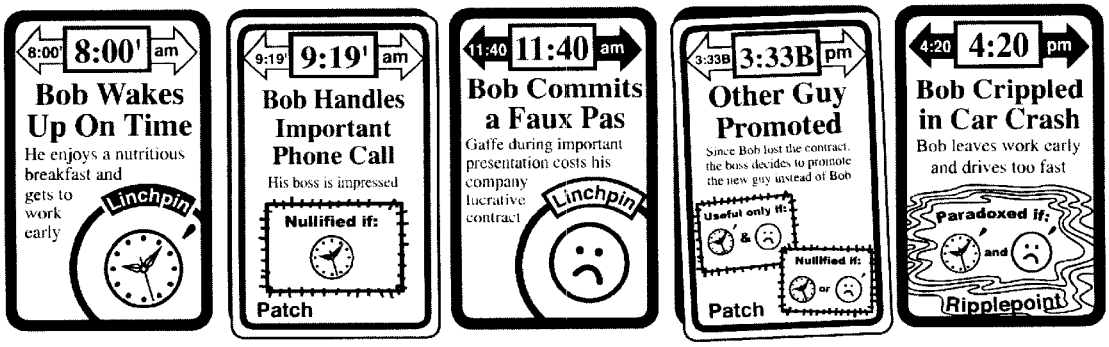

FIG. 6 shows the Timeline after the Paradoxes created in FIG. 5 have both been Patched. We see now that if Bob wakes up on time, he's there at 9:19 to take the important call; however, because of his faux pas at 11:40, he ends up being passed over for a promotion. News that his promotion went to someone else causes Bob to leave work early, and he still ends up getting in that car wreck at 4:20.

Figure 7:
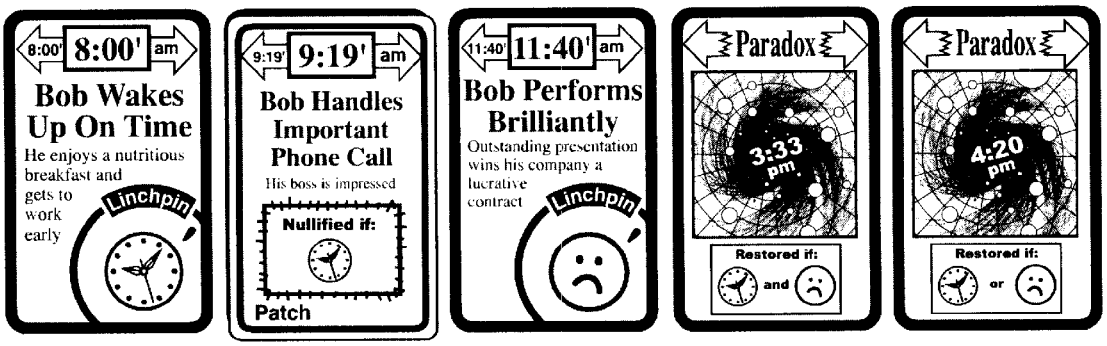

In FIG. 7, a player has again used time travel to erase Bob's embarrassing mistake in the meeting at 11:40. Now, with both Linchpins flipped to the alternate state, the 4:20 PM event has finally been rippled. Notice too that the 3:33-B Patch, which was played in FIG. 6, has now been Nullified and removed. The underlying 3:33 Paradox remains open.

Figure 8:
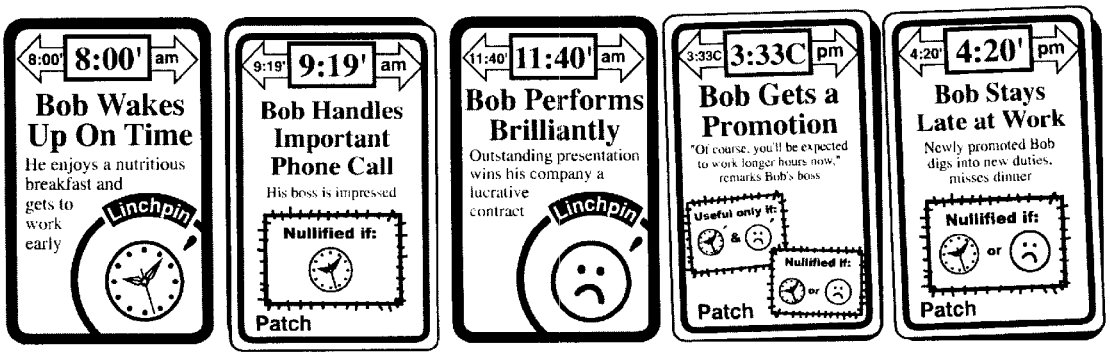

Lastly, in FIG. 8, we see what the Timeline looks like with Bob's previously disastrous day completely re-written via time travel. With both Linchpins flipped, it has become possible to play the 3:33-C Patch ("Bob Gets a Promotion") and the 4:20' Patch ("Bob Stays Late at Work"). Now, depending on the victory conditions of the imaginary game that employs this mechanism with these events, someone may even be ready to win!

Conclusions and Scope

While the above contains many specifics, these should not be construed as limitations on the scope of the invention, but rather as an exemplification of one potential embodiment therefore. Clearly, there are an endless number of time travel scenarios that could be depicted in this format. Time spans that are possible range from the events of a single day (as shown above) to those encompassing years, decades, or even centuries. There is no end to the subject matter that could be explored using this unique method of interactive storytelling. Moreover, the usefulness of this narrative form could extend well beyond the range simply of game-playing, but into education and strategic planning as well. Also, while cards are depicted here, this mechanism could be used to present changing historical timelines using other media, such as for example, windows on a computer screen. Thus, the scope of this invention should be determined by the appended claims and their legal equivalents, rather than by the examples given.

I claim:

1. A method of playing a card game simulating the effects of time travel comprising the steps of:

(a) providing a plurality of playing cards printed with identifying means and descriptions of significant even, said cards collectively characterizing a particular span of history, with certain events in the sequence being marked as pivotal and theoretically changeable via time travel, and other events being dependent upon said pivotal events, (b) utilizing both sides of said event cards, so that each card may be turned face down to reveal an alternate outcome for said event printed on the other side, (c) marking said cards with a series of reference symbols, so that a unique symbol is associated with each said pivotal event, with said symbols also appearing on said dependent event cards where said symbols indicate causality between said pivotal events and said dependent events, (d) arranging said cards on a playing surface, such that they may be viewed by all players, (e) providing rules by which players may pretend to use time travel to alter the outcome of said pivotal events, by turning over said pivotal event cards and with them any dependent event cards indicated by said causality symbols, (f) interpreting the current state of said arrangement of cards as the current historical reality in the context of a game.

* * * * *